US008357027B2

(12) United States Patent
Saikin

(10) Patent No.: US 8,357,027 B2
(45) Date of Patent: Jan. 22, 2013

(54) POLISHING PAD AND METHOD OF MANUFACTURE

(75) Inventor: Alan H. Saikin, Landenberg, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 1075 days.

(21) Appl. No.: 11/494,050

(22) Filed: Jul. 27, 2006

(65) Prior Publication Data

US 2007/0042693 A1 Feb. 22, 2007

Related U.S. Application Data

(60) Provisional application No. 60/709,280, filed on Aug. 18, 2005.

(51) Int. Cl.
*B24B 7/22* (2006.01)

(52) U.S. Cl. ..... 451/56; 451/527; 51/298

(58) Field of Classification Search ..... 451/921, 451/526, 527, 534, 56; 51/293, 296, 298, 51/300

See application file for complete search history.

(56) References Cited

U.S. PATENT DOCUMENTS

| | | | | |
|---|---|---|---|---|
| 5,578,362 | A * | 11/1996 | Reinhardt et al. | 428/147 |
| 5,876,266 | A * | 3/1999 | Miller et al. | 451/36 |
| 5,893,796 | A | 4/1999 | Birang et al. | |
| 5,976,000 | A | 11/1999 | Hudson | |
| 6,685,540 | B2 | 2/2004 | Cherian et al. | |
| 6,848,974 | B2 | 2/2005 | Hasegawa et al. | |
| 2002/0077036 | A1 | 6/2002 | Roberts et al. | |
| 2004/0053007 | A1 | 3/2004 | Huh et al. | |
| 2004/0082276 | A1 | 4/2004 | Prasad | |
| 2004/0203320 | A1 | 10/2004 | Hosaka et al. | |
| 2004/0244299 | A1 | 12/2004 | Ogawa et al. | |
| 2004/0259484 | A1 | 12/2004 | Prasad et al. | |
| 2005/0014376 | A1 | 1/2005 | Shiho et al. | |
| 2005/0215177 | A1 | 9/2005 | Prasad | |

* cited by examiner

*Primary Examiner* — Robert Rose
(74) *Attorney, Agent, or Firm* — Blake T. Biederman

(57) ABSTRACT

The present invention relates to a method of manufacturing a polishing pad with embedded polymeric capsules useful for planarizing a substrate in a CMP process using a polishing composition. The method reduces non-uniformity of the polishing pad due to capsule floating, differential heating and capsule expansion by the use of novel capsule materials. The method also increases the efficiency of the manufacturing process by reducing the number of defective products and reducing waste.

8 Claims, 2 Drawing Sheets

POLISHING PAD AND METHOD OF MANUFACTURE

CROSS REFERENCE TO RELATED APPLICATION

This application claims the benefit of U.S. Provisional Application Ser. No. 60/709,280 filed Aug. 18, 2005.

BACKGROUND

The present invention generally relates to a method of manufacturing a polishing pad useful for polishing and planarizing substrates using a chemical-mechanical planarization ("CMP") process. More particularly, the method of the present invention improves uniformity both within the pad and from one pad to another.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition, also known as sputtering, chemical vapor deposition, plasma-enhanced chemical vapor deposition, and electrochemical plating.

As layers of materials are sequentially deposited and removed, the uppermost surface of the wafer becomes nonplanar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

In a typical CMP process, a lower platen having a circular rotating plate holds a polishing pad; the polishing pad is attached such that the polishing surface of the polishing pad faces up. A polishing composition, which typically contains chemistry that interacts with the substrate and may contain abrasive particles, is supplied to the polishing surface of the polishing pad. An upper platen having a rotating carrier holds a substrate; the substrate is held such that the surface to be planarized faces down. The carrier is positioned so that its axis of rotation is parallel to and is offset from that of the polishing pad; additionally, the carrier can be oscillated or otherwise moved about the surface of the polishing pad as is appropriate for the CMP process. The substrate and the polishing pad are brought into contact and forced together with downward pressure by the upper platen, whereby the polishing composition on the surface of the polishing pad is contacted with the surface of the substrate (the working environment), causing the desired chemical reaction, and mechanical polishing takes place.

Optionally, the CMP process is continually monitored throughout in order to determine when the desired amount of material has been removed from the surface of the substrate. This is typically done by in-situ optical end-point detection that involves projecting laser light through an aperture or a window in the polishing pad from the platen side so that the laser light is reflected off the polished surface of the substrate and is measured by a detector. The amount of light that is reflected corresponds to the amount of material that has been removed from the surface of the substrate. When the amount of light detected equals a predetermined value, the CMP process has reached the desired end-point and the CMP process is terminated.

Polishing pads can be manufactured in a variety of ways, such as casting a cake or by casting a sheet. In a typical manufacturing process, the polymer pad material ingredients, which may include one or more pre-polymers, cross-linking agents, curing agents and abrasives, are mixed, resulting in a resin. The resin is transferred to a mold by pouring, pumping or injecting etc. The polymer typically sets quickly and may finally be transferred to an oven for completion of the curing process. The cured cakes or sheets are then cut to a desired thickness and shape.

Polishing pad surface asperities aid in transporting the polishing composition during the CMP process and can be created on the polishing surface of the polishing pad in many ways. According to one method, as disclosed in U.S. Pat. No. 5,578,362, surface asperities are created by embedding hollow polymeric capsules in a polishing pad comprising a polymeric matrix. Specifically, surface asperities are created by rupturing the capsules and exposing the hollow void contained therein to the working environment on the surface of the polishing pad. This is accomplished by conditioning the polishing pad.

Typically, conditioning consists of abrading the polishing surface of the polishing pad with diamond points (or other scoring or cutting means) embedded in the conditioning surface of a conditioning pad. As the conditioned polishing pad is used, the pores wear away and become clogged with debris from the CMP process. This results in the polishing pad losing surface asperities with use. Asperities can be regenerated as the polishing surface is worn during the CMP process, by continuous or intermittent conditioning. Asperities can also be regenerated without a conditioning pad as the embedded polymeric capsules are exposed and ruptured during polishing. For convenience, the term conditioning refers to regeneration of surface asperities whether through pad wear exposing new cavities, through the use of a conditioning pad or through other regeneration techniques.

Large scale texture is created on the polishing surface of the polishing pad by introduction of grooves. Groove pattern design and groove dimensions affect polishing pad characteristics and CMP process characteristics. Polishing pad grooving is well known in the art, and known groove designs include radial, circular, spiral, x-y and others. Typically, grooves are introduced in the polishing surface of a polishing pad after it is formed through mechanical means such as a straight blade like a chisel or other cutting means.

Polishing pads made according to the '362 patent, however, suffer from the tendency of the capsules to expand. The polymeric capsules expand during the curing process as they are heated by the exothermic curing reaction. The amount of expansion is difficult to control for two reasons. Expansion of the capsules due to heat is largely controlled by the ability of the shell to withstand the increasing pressure as temperature increases, which in turn depends on the shell thickness, among other things. The shells are typically very thin and so even a very small variation in shell thickness translates to a large percentage difference and a large relative difference in expansion.

The other factor that makes capsule expansion hard to control is the effect of differential heating. Differential heating occurs because the polymeric capsules act as thermal insulators, reducing the flow of heat from areas of higher temperature to areas of lower temperature. The areas of the cake or sheet close to the surface (those areas exposed to air or the mold) transfer heat to the surrounding environment and cool. The center of the cake or sheet, however, is insulated and the heat from the reaction builds up. The result is greater capsule expansion in the center of the mold than in the areas exposed to the air or the mold itself. Uneven expansion of the capsules results in non-uniform pad porosity, and therefore non-uniform pad density, which is disadvantageous. Therefore what is needed is a method of manufacturing a polishing pad that improves product uniformity and process consistency.

STATEMENT OF THE INVENTION

A first aspect of the invention provides a method of manufacturing a polishing pad useful for polishing substrates in a chemical mechanical polishing process using a polishing composition, the method comprising the steps of: preparing a polymeric matrix material; mixing polymeric capsules into the polymeric matrix material to distribute the polymeric capsules within the polymeric matrix material, the polymeric capsules comprising a polymeric shell and a liquid core contained within the polymeric shell; and forming a polishing pad, the polishing pad having the polymeric capsules distributed in the formed polymeric matrix material, the polymeric shell holding the liquid core to prevent contact with the polymeric matrix material during forming, and the polymeric shell having a polishing surface that ruptures to create surface asperities for polishing the substrates.

A second aspect of the invention provides a polishing pad useful for polishing substrates in a chemical-mechanical polishing process using a polishing composition, the polishing pad comprising: a polymeric matrix material containing polymeric capsules, the polymeric capsules comprising a polymeric shell and a liquid core contained within the polymeric shell, the polymeric shell for preventing the liquid core contacting the polymeric matrix material during forming, and for rupturing during conditioning to form surface asperities; and a polishing surface comprising the polymeric matrix material and asperities defined by the exposed cavities of the embedded polymeric capsules.

DETAILED DESCRIPTION

The present invention provides a method of manufacturing a polishing pad useful for planarizing a substrate in a chemical mechanical polishing process with increased ease and efficiency.

Figure 1:
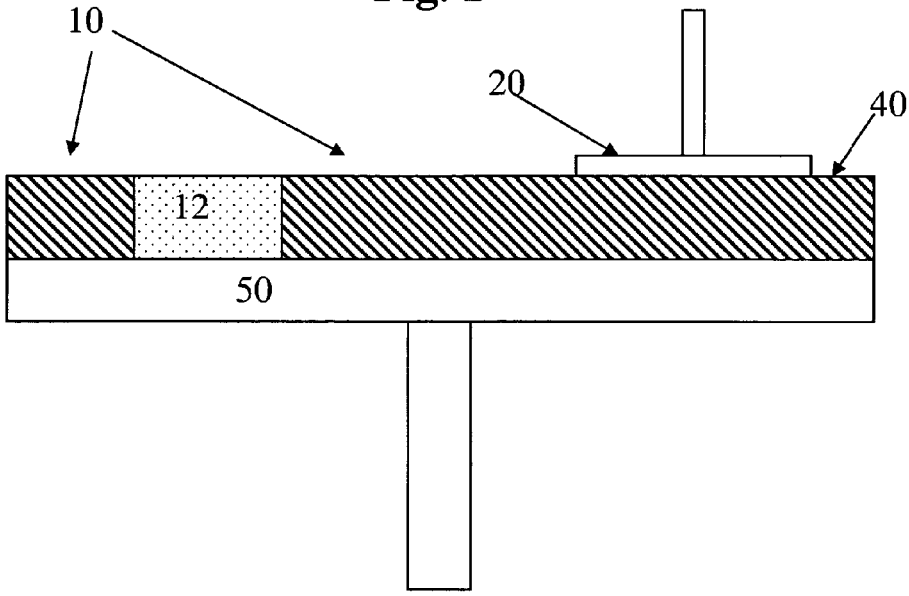
FIG. 1 is a schematic-partial plan view illustrating the polishing pad of the present invention as used in a CMP process

Referring to FIG. 1, a polishing pad 10 of the present invention is shown mounted on a platen 50. The polishing pad 10 has a polishing surface 40 that is contacted with a substrate 20, such as a patterned silicon wafer. Also shown is a region of the polishing pad 12 that is shown in greater detail in FIG. 2

Figure 2:
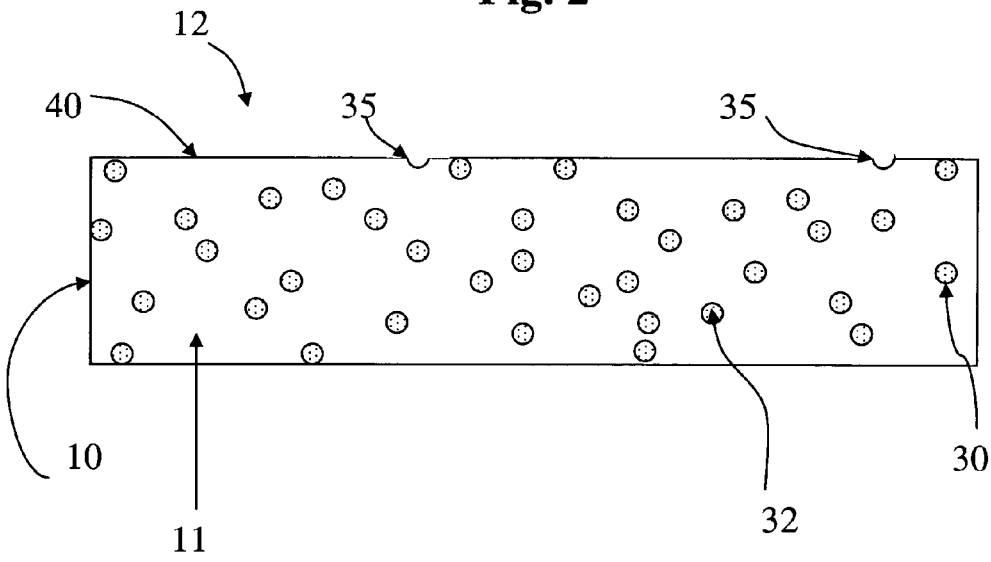
FIG. 2 is a schematic-cross-sectional view of the polishing pad of representing region 12 of FIG. 1.

Referring now to FIG. 2, the method comprises preparing a polymeric matrix material 11, mixing polymeric capsules 30 into the polymeric matrix material 11 and forming a polishing pad 10. In particular, the polymeric capsules 30 have a polymeric shell 31 (FIG. 3) and a liquid core 32. The polymeric capsules 30 have increased density and increased resistance to expansion when exposed to heat during the manufacturing process. The result is a reduction in the tendency for the polymeric capsules 30 to float or sink in the polymeric matrix material 11 before the pad is formed and also less within pad variation in pore size. This allows for a manufacturing process using a slower curing reaction, and an associated longer cure time, which produces less heat.

The polymeric matrix material 11 may comprise a thermoplastic material, for example, a thermoplastic polyurethane, polyvinyl chloride, ethylene vinyl acetate, polyolefin, polyester, polybutadiene, ethylene-propylene terpolymer, polycarbonate and polyethylene teraphthalate, and mixtures thereof. In addition, matrix material 11 may comprise a thermoset material, for example, a cross-linked polyurethane, epoxy, polyester, polyimide, polyolefin, polybutadiene and mixtures thereof. Preferably, the polymeric matrix material 11 comprises a polyurethane, and more preferably comprises a cross-linked polyurethane, such as IC 1000™ and Vision-Pad™ polishing pads manufactured by Rohm and Haas Electronic Materials CMP Technologies. The polymeric matrix material may be in a solid phase, such as particles for molding, sintering or gluing or in a flowable phase such as a liquid prepolymer blend. Preferably the polymeric matrix material 11 is in a flowable phase to facilitate mixture with the polymeric capsules 30.

The polymeric shell 31 may comprise a thermoplastic material, for example, a thermoplastic poly(vinylidene chloride) PDVC, polyurethane, polyvinyl chloride, ethylene vinyl acetate, polyolefin, polyester, polybutadiene, ethylene-propylene terpolymer, polycarbonate and polyethylene teraphthalate, and mixtures thereof. In addition, the polymeric shell 31 may comprise a thermoset material, for example, a cross-linked polyurethane, epoxy, polyester, polyimide, polyolefin, polybutadiene and mixtures thereof. Preferably, the polymeric shell 31 comprises PDVC. Before forming, the polymeric matrix material 11 will react with water to produce foaming, which is undesirable. Preferably, the polymeric shell 31 is non-porous and prevents the liquid core 32 from contacting the polymeric matrix material 11 before the pad is formed or cured. After forming, however, the polymeric matrix material 11 preferably does not react with the liquid core, and the polymeric shell 31 need not prevent the liquid core 32 from contacting the polymeric matrix material 11. The liquid core 32 may permeate or diffuse through the polymeric shell 31 and be absorbed by the polymeric matrix material 11, or the polymeric shell 31 may dissolve. The shell typically has a thickness between 10 nm and 2 μm. Preferably, the shell has a thickness between 25 nm and 1 μm.

The liquid core 32 may comprise an aqueous or non-aqueous liquid, such as an alcohol. Preferably, the liquid core comprises an aqueous solution, for example, an aqueous solution of organic or inorganic salts, a solution of prepolymers or oligomers, or a solution of water soluble polymers. Optionally, the liquid core may also contain reagents for the CMP process. Most preferably the liquid core is water with only incidental impurities, such as de-ionized water with incidental dissolved gases. Typically, the polishing composition (not shown) is aqueous-based and contains the desired chemistry for the CMP process. When the polishing pad is conditioned, dissolves or wears away during polishing, the polymeric capsules are ruptured, and the liquid core may escape and mix with the polishing composition. It is disadvantageous for the liquid core to adversely affect the polishing composition by reacting with the chemistry or by otherwise altering the polishing characteristics of the polishing composition. Preferably, the liquid core is an aqueous-based solution. More preferably the liquid core is water, including incidental impurities, and most preferably is de-ionized water because de-ionized water has a low risk of interacting with the polishing pad, the polishing composition or the substrate. Preferably, the polymeric shell is less wear-resistant than the polymeric matrix material so that the polymeric shell is worn away during polishing, rupturing the polymeric capsule, and the polymeric shell does not interfere with or adversely affect the polishing process.

The polymeric matrix material and the polymeric capsules can be mixed by conventional methods such as agitation or by a dry feed process. If mixing is performed while the polymeric matrix material is in a flowable phase, a difference in the density of the polymeric capsules and the polymeric matrix material will cause the polymeric capsules to float. Depending on the viscosity of the polymeric matrix material in a flowable phase and the relative difference in the density of the polymeric matrix and the polymeric capsule, the mixture may separate. To avoid separation, the mixture may be agitated or recirculated to maintain the distribution of the polymeric capsules in the polymeric matrix. Alternatively, the density of the polymeric capsules can be increased to reduce the floating effect. Typically the polymeric shell and the polymeric matrix material have similar densities, and the polymeric shell is thin. The polymeric capsules of the present invention have a density that more closely matches the density of the polymeric matrix material, because the liquid core has a greater density. Preferably, the polymeric capsules have a density within 50 percent of the density of the polymeric matrix material. More preferably, the polymeric capsules have a density within 30 percent of the density of the polymeric matrix material. Most preferably the polymeric capsules have a density within 15 percent of the polymeric matrix material. For the purposes of the specification, a density, d1 (capsule, including shell and liquid core), is within certain percent, x %, of a second density, d2 (polymeric matrix material), if the following is true:

$$(d1*(1-(x/100)))\leqq d2\leqq((1+(x/100))*d1)$$

Furthermore, for purposes of this invention, density represents the density of the polymeric matrix and polymeric capsules just before mixing of the polymeric capsules into the polymeric matrix material. For example, when adding polymeric capsules to a liquid prepolymer blend, the density measurement for the liquid prepolymer that cures into the polymer matrix and the density measurement for the polymeric capsules occurs before introduction into the prepolymer. For these cast polishing pads, matching the density of the capsule to the liquid polymer facilitates the use of polymers that require extended curing cycles by reducing the settling or floating of capsules that can lead to non-uniform polishing pads. Optionally, premixing the components may improve distribution of the polymeric capsules.

In addition to separation due to flotation, non-uniformity of polymeric capsule distribution in the polymeric matrix material can result from the mixing step in the manufacturing process. In a typical process, the polymeric capsules are stored in a vertical tank or hopper, and are drained out by the force of gravity, for example in a mass flow feed delivery system. When the polymeric capsules have a hollow core, such as those of the prior art, they do not flow regularly or evenly. The hollow capsules lack a sufficient mass to flow evenly under the force of gravity. The polymeric capsules of the present invention, having a liquid core, have a greater density, and, therefore, greater mass than those of the same size having a hollow core. This greater density, and greater mass, allows the polymeric capsules to flow more evenly and regularly under the force of gravity. When the polymeric capsules flow more evenly, a more uniform distribution is achieved when the polymeric capsules are fed into a flow of the polymeric matrix material.

Another method for decreasing non-uniformity in the distribution of the polymeric capsules in the polymeric matrix material is by the use of a mass flow feed delivery system wherein the fluidity of the polymeric capsules is controlled. The polymeric capsules can be made to flow evenly, and thereby may be fed evenly into the polymeric matrix material evenly, by fluidizing the polymeric capsules. According to one method, this can be done by evenly supplying a flow of gas through the polymeric capsules. This flow of gas increases the spacing between the polymeric capsules, which reduces the resistance to flow of the polymeric capsules. Once the polymeric capsules have been fluidized, they can be fed into a flow of the polymeric matrix material at a constant rate. This has the effect of evenly distributing the polymeric capsules in the polymeric matrix material to a high degree of uniformity.

The polishing pad 10 can be formed by conventional methods such as casting, injection molding, co-axial injection, extrusion, sintering, gluing, etc. Preferably the polishing pad 10 is formed by casting a sheet or a cake. When the polishing pad 10 is so formed, the mixture is transferred by pouring or injection into a mold, which can be open or closed. Optionally, sheets are continuously cast into a roll for increased production rates. The mixture is then preferably cured by the use of curing agents that can be light-activated, thermal-activated, time-activated or chemically-activated. Once cured, the batch is removed from the mold and cut into individual polishing pads by mechanical means such as skiving or stamping, or by laser cutting. Optionally, the polishing pad is formed by casting the mixture in a mold, curing, and skiving. The liquid core is particularly useful for limiting the pad-to-pad variation that may occur from casting polymeric cakes. For example, the exothermic reactions that can heat the center and top of the cake provide less thermal expansion to liquid-filled capsules than gas-filled capsules.

The polishing pad may also include an aperture or a window for use with an in-situ optical end-point detection apparatus. The aperture may be introduced in the formation process, for example by molding, or may be created by removing a portion of the formed polishing pad, for example by cutting. Likewise the window may be included in one step by molding or may be added after the polishing pad is formed by gluing. Optionally the polishing pad may have neither an aperture nor a window and may be transparent in at least a portion of the polishing pad. To create a transparent polishing pad according to the present invention, the liquid core may be selected such that incident light is not substantially scattered or refracted when encountering the capsule-core interface, and passes through the polishing pad. For transparent polishing pads it is preferable to use a clear subpad or a subpad with an opening that allows an optical signal to freely pass. Furthermore, leaving the pad ungrooved in a particular region can also improve the signal strength.

The polymeric capsules of the present invention can have a liquid core after forming the polishing pad, and therefore do not act as thermal insulators. These polymeric capsules can conduct heat more effectively from regions of higher temperature within the polishing pad to regions of lower temperature, to reduce differential heating. Additionally because the polymeric capsules have a liquid core, the polymeric capsules resist expansion, resulting in more predictable and controllable pore size in the finished polishing pad. Preferably the diameter of the polymeric capsules expands less than 20% during the manufacturing process. More preferably, the diameter of the polymeric capsules expands less than 15% during the manufacturing process. Most preferably, the diameter of the polymeric capsules expands less than 10% during the manufacturing process.

The liquid-filled polymeric capsules may expand significantly, however, if the temperature of the polishing pad exceeds the boiling point of the liquid core. The temperature that the polishing pad will reach is determined by the polymer chemistry associated with the curing process of the polymeric matrix material. Expansion of the polymeric capsules can be avoided or reduced by selecting a liquid core with a boiling point above the temperature reached during the manufacturing process for a given polymeric matrix material or by using prepolymers that produce less exothermic energy, such as prepolymers with extended cure cycles. Furthermore, the liquid core of the polymeric capsules can reduce machining time for grooving with circular lathes or high-speed bits by facilitating clean cutting of the polishing pad. Finally, the liquid core can improve laser grooving by reducing melting of the side walls of grooves and perforations.

In addition to reducing capsule expansion and density non-uniformity, the ability of the liquid core to transfer heat serves to reduce or eliminate polymeric matrix material melting or charring during the grooving process. The liquid core serves to cool the polymeric matrix material around the grooves during forming by conducting heat away from the region and serves to raise the thermal mass of the polishing pad, lowering the temperature increase of the polymeric matrix material. Therefore, the polishing pad of the present invention can be grooved with less melting or charring and without the need for air-cooling or introduction of substantial amounts of water.

Referring again to FIG. 2, when the polymeric capsules at or near the polishing surface 40 are ruptured during conditioning, a pore 35 is created in the polishing surface 40. The polishing composition displaces the liquid core 32 and fills the pore 35. The pore 35 then serves to transport the polishing composition. The size of the pore 35 affects the transportation of the polishing composition.

Figure 3:
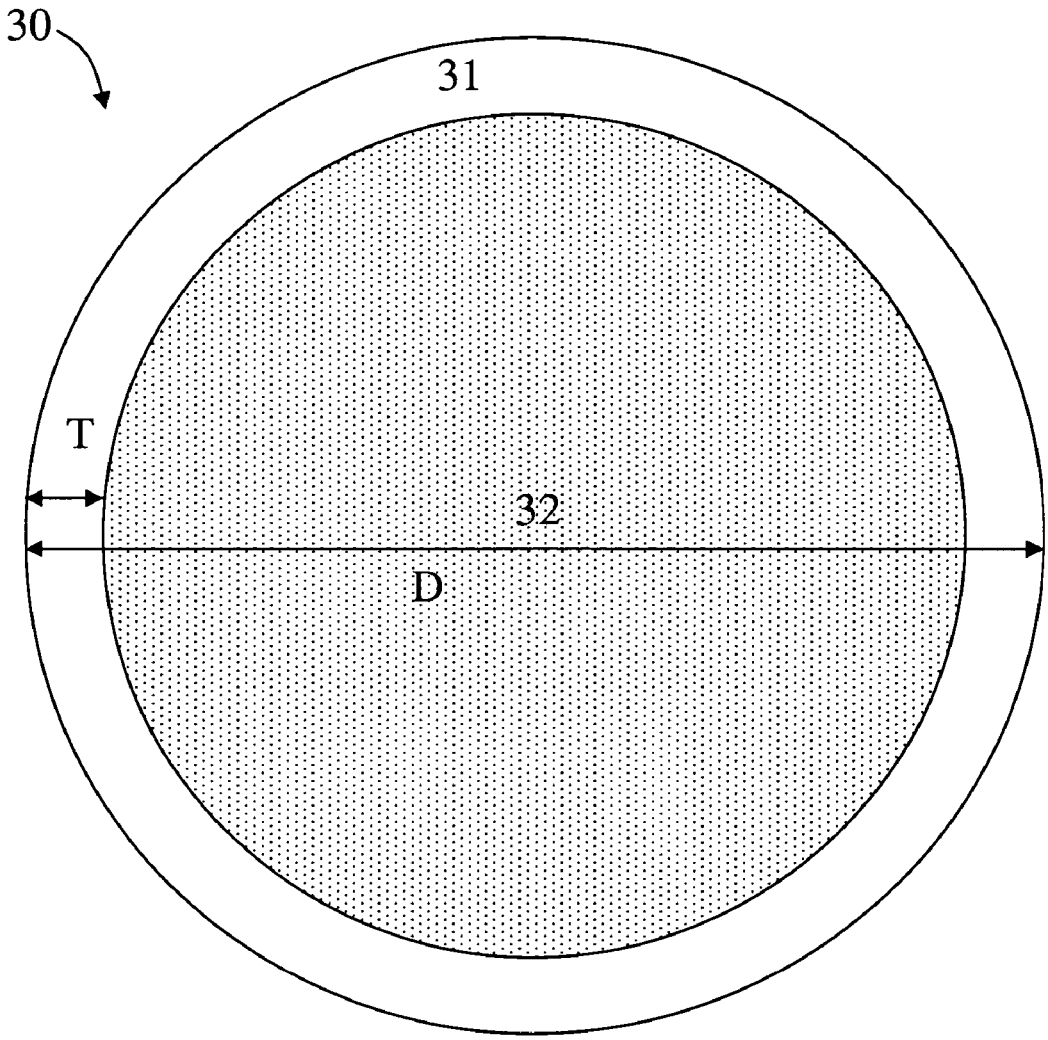
FIG. 3 is a schematic view of a liquid-filled polymeric capsule of FIG. 2.

FIG. 3 shows an expanded view of a polymeric capsule 30. The polymeric capsule 30 comprises a polymeric shell 31 and a liquid core 32, and has a diameter D. The polymeric shell has a thickness T. The thickness T is shown as relatively small compared to the diameter D of the polymeric capsule 30. Preferably, the polymeric capsule 30 has a diameter D between 1 μm and 150 μm. More preferably, the polymeric capsule 30 has a diameter between 2 μm and 75 μm. Preferably, the polymeric shell 31 has a thickness T between 0.01 μm and 5 μm. More preferably, the polymeric shell 31 has a thickness T between 0.05 μm and 2 μm.

The method of the present invention provides a polishing pad with integral texture with improved uniformity, providing beneficial polishing characteristics, with the added benefit of increased ease and decreased cost production and waste. In particular, the polishing pad's liquid core can limit thermal expansion during casting to provide more uniform porosity throughout the polishing pad. Furthermore, the liquid core is particularly useful for limiting the pad-to-pad variation that may occur from casting polymeric cakes. Furthermore, the addition of a liquid core to the polymeric capsule can transform an optically opaque polishing pad unsuitable for chemical mechanical polishing into an optically transparent polishing pad suitable for endpoint detection with optical signals, such as those generated by lasers. In addition, the liquid core increases the pad's stiffness that can improve the pad's planarization ability. Furthermore, the liquid core improves the thermal conductivity of the pad in comparison to gas-filled polymeric capsules. Finally, the liquid core can improve the polishing pad's machinability for cutting grooves and especially cutting complex grooves, such as modified radial grooves.

The invention claimed is:

1. A method of manufacturing a polishing pad useful for polishing substrates in a chemical mechanical polishing process using an aqueous-based polishing composition, the method comprising the steps of:

feeding polymeric capsules into a liquid polymeric matrix material, the polymeric capsules having a diameter and comprising a polymeric shell having a liquid core consisting essentially of water and incidental impurities contained within the polymeric shell and the liquid polymeric matrix material being a polyurethane prepolymer blend;

mixing the polymeric capsules into the liquid polymeric matrix material to distribute the polymeric capsules within the liquid polymeric matrix material, and wherein the liquid polymeric matrix material has a first density measured before the mixing and the polymeric capsules have a second density measured before the mixing within 30 percent of the first density;

curing the liquid polymeric matrix material with the polymeric capsules distributed in a cured polymeric matrix material and the diameter of the polymeric capsules expanding less than 20 percent, the polymeric shell holding the liquid core to prevent contact with the liquid polymeric matrix material during forming and to prevent foaming from, water reacting with the liquid polymer matrix material, and the polymeric shell having a polishing surface that ruptures to release the liquid core and to create surface asperities for polishing the substrates and the polymeric shell being less wear-resistant than the cured polymeric matrix material; and cutting grooves into the cured polymeric matrix material with the liquid core conducting heat to cool the polymeric matrix material and to form a polishing pad consisting essentially of polymeric capsules in the cured polyurethane matrix; and the liquid core not reacting with the aqueous-based polishing composition or altering the polishing characteristics of the aqueous-based polishing composition during polishing.

2. The method of claim 1 wherein the step of curing the liquid polymeric matrix material occurs in a mold.

3. The method of claim 1 including the additional step of casting a sheet of the liquid polymeric matrix material.

4. The method of claim one wherein the step of mixing polymeric capsules into the polymeric matrix material includes the steps of fluidizing the polymeric capsules and feeding the fluidized polymeric capsules into the liquid polymeric matrix material.

5. The method of claim 1 wherein the mixing includes co-axial injection of the polymeric capsules and the liquid polymeric matrix material.

6. The method of claim 1 including the additional step of extruding the polymeric capsules and the liquid polymeric matrix material.

7. The method of claim 1 wherein the diameter of the polymeric capsules expands less than 15 percent during the manufacturing of the polishing pad.

8. The method of claim 1 wherein the diameter of the polymeric capsules expands less than 10 percent during the manufacturing of the polishing pad.

* * * * *